United States Patent [19]

Hilfiker et al.

[11] 4,391,557

[45] Jul. 5, 1983

[54] RETAINING WALL FOR EARTHEN FORMATIONS AND METHOD OF MAKING THE SAME

[75] Inventors: William K. Hilfiker, Eureka, Calif.; Harold O. Hilfiker, deceased, late of Eureka, Calif., by Louise E. Hilfiker, executor; William B. Hilfiker, Eureka, Calif.

[73] Assignee: Hilfiker Pipe Co., Eureka, Calif.

[21] Appl. No.: 320,326

[22] Filed: Nov. 12, 1981

Related U.S. Application Data

[63] Continuation-in-part of Ser. No. 56,826, Jul. 12, 1979, Pat. No. 4,329,089.

[51] Int. Cl.[3] ..... E02D 5/20; E02D 29/02

[52] U.S. Cl. ..... 405/287; 405/284

[58] Field of Search ..... 405/258, 262, 272, 284, 405/286, 287

[56] References Cited

U.S. PATENT DOCUMENTS

| | | | |
|---|---|---|---|
| 1,693,311 | 11/1928 | Miller et al. | 405/287 X |
| 1,812,364 | 6/1931 | Oursler | 405/287 |
| 2,193,425 | 3/1940 | Lake | 405/272 X |
| 3,981,038 | 9/1976 | Vidal | 405/284 X |
| 4,116,010 | 9/1978 | Vidal | 405/262 |
| 4,117,686 | 10/1978 | Hilfiker | 405/284 |
| 4,341,491 | 7/1982 | Neumann | 405/258 |

FOREIGN PATENT DOCUMENTS

| | | | |
|---|---|---|---|
| 2303121 | 10/1976 | France | 405/258 |
| 610966 | 5/1979 | Switzerland | 405/286 |

*Primary Examiner*—David H. Corbin

*Attorney, Agent, or Firm*—Naylor, Neal & Uilkema

[57] ABSTRACT

An earthen formation is retained by welded wire trays embedded in the formation to effect its reinforcement. A concrete face panel is cast in place at the face of the formation and reinforced by upturned ends on the trays.

8 Claims, 7 Drawing Figures

RETAINING WALL FOR EARTHEN FORMATIONS AND METHOD OF MAKING THE SAME

RELATED APPLICATIONS

The present application is a continuation-in-part of copending application Ser. No. 056,826, filed July 12, 1979 by the inventors herein, now U.S. Pat. No. 4,329,089, and entitled: Method and Apparatus for Retaining Earthen Formations through Means of Wire Structures. It also relates to U.S. Pat. No. 4,117,686, granted Oct. 3, 1978 to William K. Hilfiker, one of the coinventors herein.

BACKGROUND OF THE INVENTION

The invention relates to wire retaining walls for earthen formations and, more particularly, is directed to such a wall which employs integral welded wire trays which are embedded in the formation and a concrete face which is cast in place at the face of the formation and reinforced by the wire trays.

The reinforcement of earthen formations by welded wire trays is taught by aforementioned related U.S. Pat. No. 4,117,686. In the reinforcement provided by the structure of that patent, the elongated bodies of the trays function to reinforce the formation and upturned face sections on the trays provide a permeable face which resist sloughing away of the formation. In the preferred embodiments, mats and/or rocks are provided behind the face sections to minimize sloughing.

Related copending application Ser. No. 056,826, teaches a retaining structure for earthen formations wherein welded wire mats are embedded within the formation and separate face mats are secured to the embedded mats at the face of the formation. In certain embodiments, a concrete face is formed in place at the face of the formation and reinforcing elements for the concrete are disposed externally of the face mats and embedded within the concrete.

SUMMARY OF THE INVENTION

The retaining wall of the present invention employs trays similar to those of U.S. Pat. No. 4,117,686 and so positions the face sections of these trays as to be external of the earthen formation to be reinforced. A concrete face or wall is then cast in place around the face sections so as to be reinforced by the sections and anchored by the trays. In the preferred embodiment, screens are spaced inwardly of the face sections at the interface of the earthen formation and the cast in place concrete face. The screens function as a backing mat for the concrete of the face and may function as part of the form structure to confine the concrete as it is cast in place.

A principle object of the present invention is to provide a retaining structure for earthen formations wherein integral welded wire trays are embedded both in the formation and a concrete face formed in place at the face of the formation.

Another object of the invention is to provide such a structure wherein backing screens having physical characteristics materially different from the welded wire trays may be located between the concrete face and the earthen formation.

Another object of the invention is to provide such a retaining structure wherein the welded wire trays function to reinforce the earthen formation over a considerable depth behind the concrete face so as to relieve loading of the face by the formation.

Still another object of the invention is to provide such a structure wherein the trays function to both reinforce and anchor the concrete face.

Yet another objection of the invention is to provide such a structure wherein trays of a simple L-shaped profile may be used and superimposed upon one another, without the necessity of employing complicated multipart assemblies.

The foregoing and other objects will become more apparent when viewed in light of the following detailed description and accompanying drawings.

DESCRIPTION OF THE PREFERRED EMBODIMENTS

Figure 1:
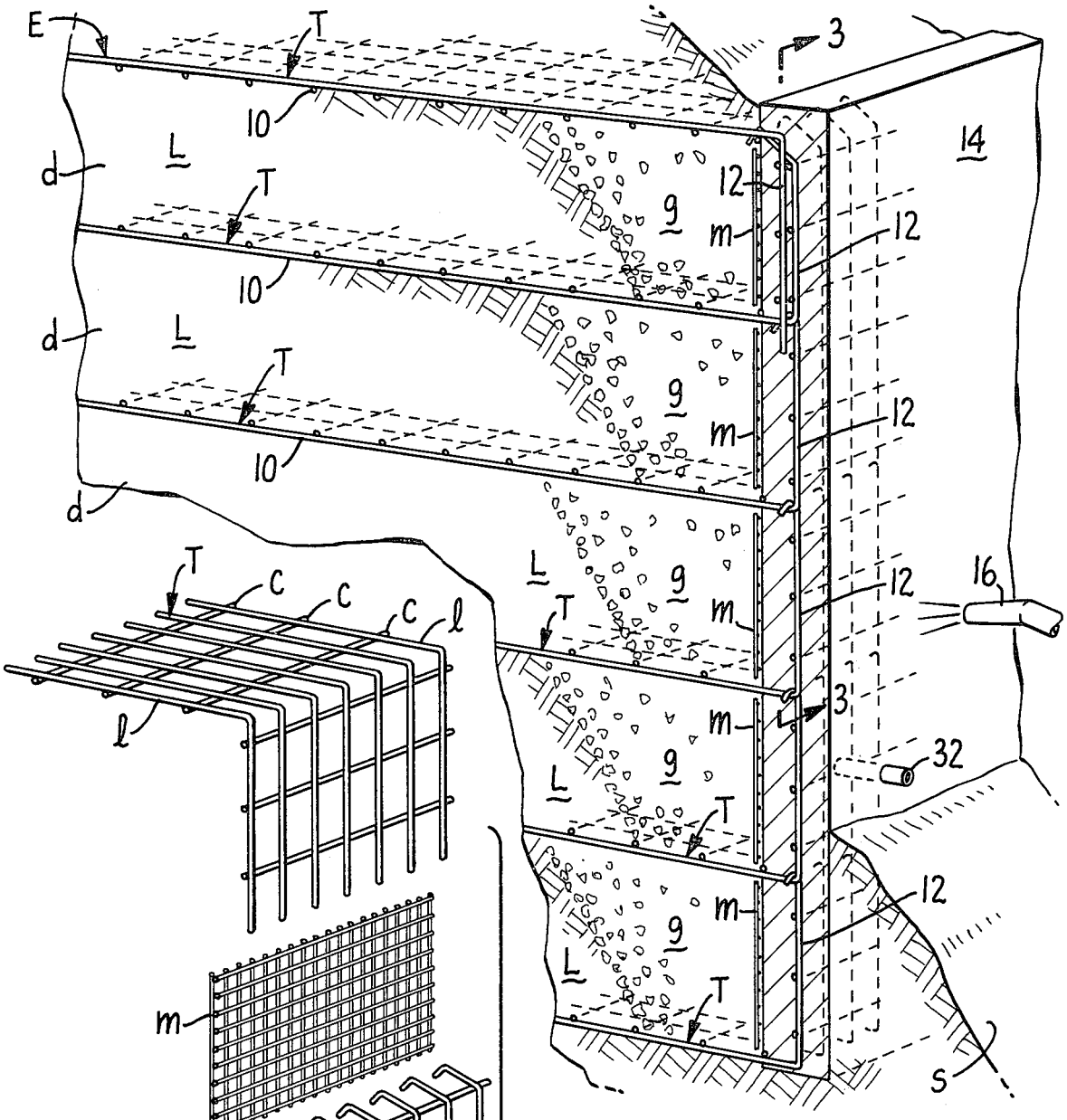
FIG. 1 is an elevational perspective view, in partial cross section, illustrating an earthen formation reinforced by a wall constructed according to the present invention.

Referring now to FIG. 1, the earthen formation is designated therein by the letter "E" and is shown as being divided into horizontal layers "L", each of which layers is comprised of backfill soil "d" and a gravel face section "g". The layers "L" have a height of from 2 to 3 feet and have interposed therebetween the body sections 10 of welded wire trays "T". In a typical embodiment, the welded wire trays comprise a gridwork of welded wire rods wherein the transversely extending cross rods "c" are spaced from one another by six to twelve inches and the longitudinally extending rods "1" are spaced from one another by two to six inches and welded to the rods "c" at the intersections therewith. The wire is typically of about seven gauge.

The trays "T" are formed with face sections 12, each of which terminates with free distal end which may be hooked over the trays thereabove. Mats "m" are spaced inwardly from the face sections and provide a backing for a concrete face 14 which is formed in place at the face of the earthen formation "E".

The wall is assembled by first excavating the face of the earthen formation to be reinforced and then successively placing and backfilling each of the trays "T" to form a composite assembly as shown in FIG. 1. After each tray is placed, the backing mat "m" is positioned behind and in spaced relation to the face section 12 of the tray and suitably held in place, as by wire ties. To prevent the backing mat from being dislodged, final filling of the gravel face section "g" may be delayed until the tray thereabove is secured in place. As each successive tray is placed, the distal ends of the face section 12 of the tray therebelow are hooked over said successive tray. When the top of the formation is reached, the uppermost tray is positioned in an inverted condition with its face section 12 extending downwardly.

After the trays are fully positioned, the face 14 is formed in place so that the face sections 12 are embedded in the concrete of the face. Thus, the face sections function to reinforce the concrete and, through means of the body sections 10, anchor the face against displacement.

Figure 3:
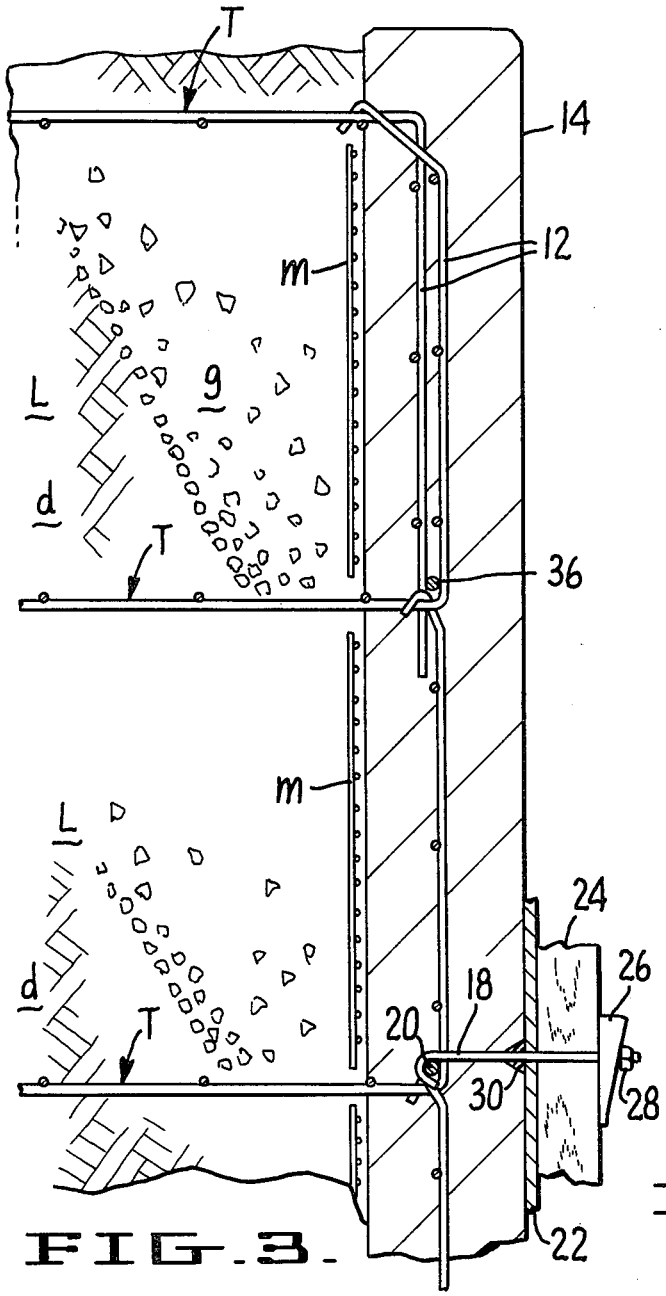
FIG. 3 is a cross-sectional elevational view of the three topmost courses of trays in an embodiment similar to that of FIG. 1, showing the form panel which may be secured to the trays to provide for pouring of the concrete face in place.

Concrete face 14 is typically six inches thick and is cast in place either by a GUNITE operation, or by a forming and pouring in place operation. A GUNITE nozzle 16 is shown in FIG. 1 to depict how the face might be placed through means of a GUNITE operation. FIG. 3 illustrates a form which may be used for a poured in place face. The form comprises snap-ties 18 hooked over rods 20 positioned to the inside of the trays "T", form panels 22, walers 24, and wedges 26. The wedges engage the walers 24 and nut 28 received on the rods 20. Grouting cores 30 are received on the rods 20 to the inside of the panels 22.

When using the form arrangement shown in FIG. 3, the face 14 is poured between the backing mats "m" and the form panel 22. Once the face is sufficiently cured, the snap-ties 18 are broken and the form panels are removed. The grouting cores 20 leave conical openings in the outer surface of the face which may, if desired, be grouted over.

Figure 2:
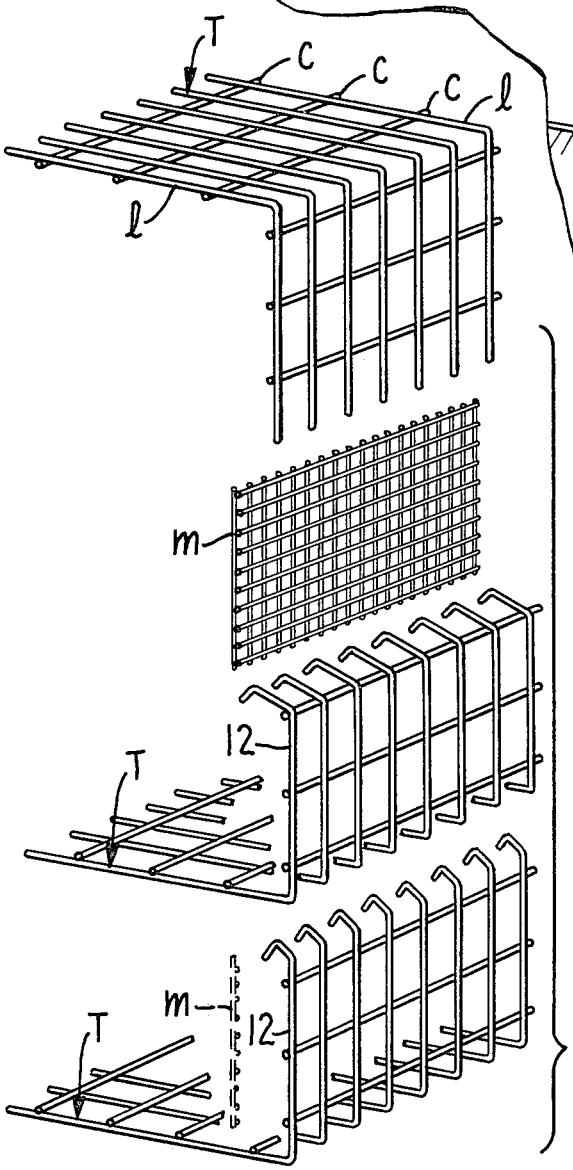
FIG. 2 is an exploded perspective view of the three uppermost trays employed in the FIG. 1 embodiment of the invention, including the screens disposed inwardly of the face sections of the trays.

The FIG. 1 to 3 embodiments are designed so that the cast in place face 14 is esentially nonstructural, insofar as retention of the earth formation is concerned. The purpose of the face is primarily to seal the earthen formation from sloughing and to provide a more attractive structure from an architectural standpoint. Because the face 14 is essentially impermeable, drain tiles 32 (see FIG. 1) are provided in the lower portion thereof. Also, as shown in FIG. 1, after formation of the face 14, soil "s" is placed in front of the lower portion of the face.

Figure 4:
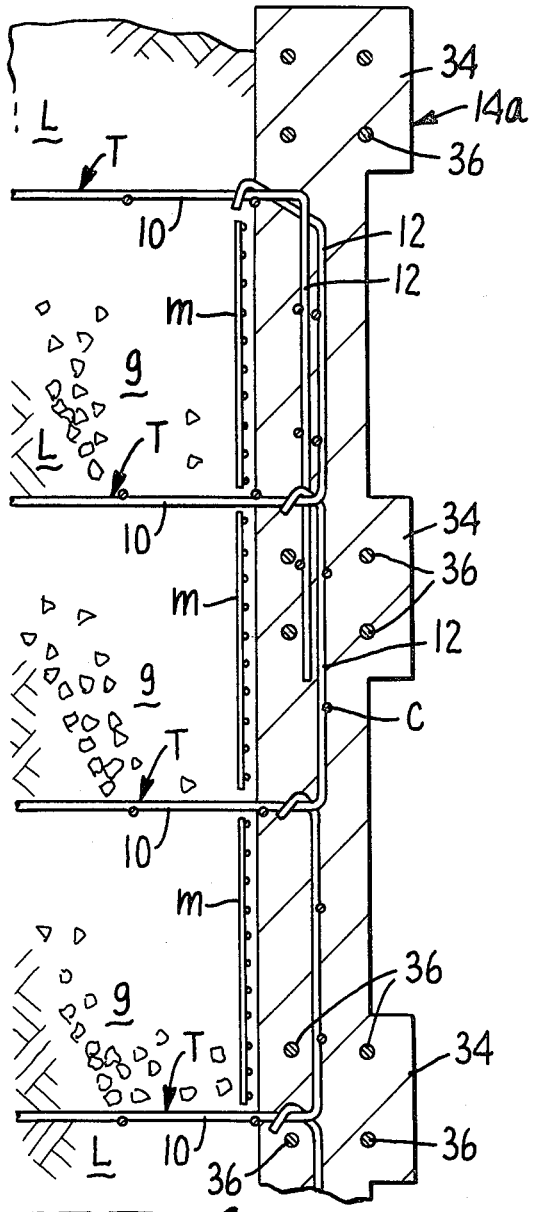
FIG. 4 is a cross-sectional elevational view of a wall constructed according to the present invention, illustrating an embodiment wherein enlarged sections are formed across the concrete face to accommodate rebar reinforcements.

The embodiment of FIG. 4 differs from that of FIG. 3 primarily in that the face, designated 14*a*, is designed to perform a more structural function. Such a function may be desirable where, for example, the trays are spaced at larger intervals, or, rock bolts are used for anchoring purposes in place of at least certain of the trays. The elements of the FIG. 4 embodiment corresponding to those of the FIG. 1 to 3 embodiments are designated by like numerals.

The FIG. 4 wall is formed by a pouring operation essentially identical to that described with reference to FIG. 3, with the exception that the form panel is configured to form ribs 34 which extend horizontally across the wall, and rebars 36 are positioned within these ribs for reinforcing purposes. Although not illustrated, it should be understood that the form for the face 14*a* would be secured in place through means of a snap-tie form similar to that shown in FIG. 3. In this case, the snap-tie would be hooked over the rods of the face sections 12.

Figure 5:
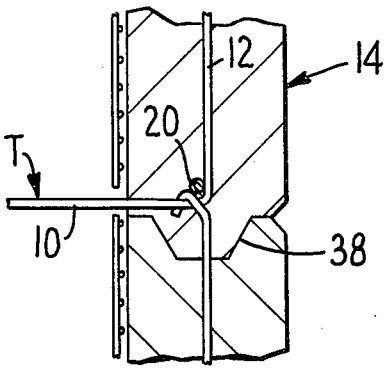
FIG. 5 is a cross-sectional elevational view of a wall constructed according to the embodiment of FIG. 3, showing how the concrete face may be poured and formed in layers, with a tongue-and-groove type joint formed between the layers.

FIG. 5 illustrates a tongue-and-groove construction joint 38 which may be formed in the concrete face 14. Such a joint would be formed by pouring the face in layers and forming a groove in the top of each layer into which the concrete of the layer thereabove is poured to form a tongue engaged with the groove.

Figure 6:
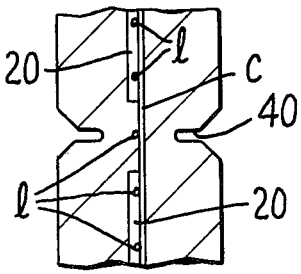
FIG. 6 is a cross-sectional plan view of a weakened plane joint which may be formed in the concrete face of a wall constructed according to the present invention.

FIG. 6 illustrates a weakened plane joint which may be formed in the face 14. The joint, designated 40, may be formed with an eight-inch hardboard and cut back to the root of the chamfer. The horizontal rods 20 ideally are interrupted (e.g., cut) at the weakened plane of every other layer "L".

Figure 7:
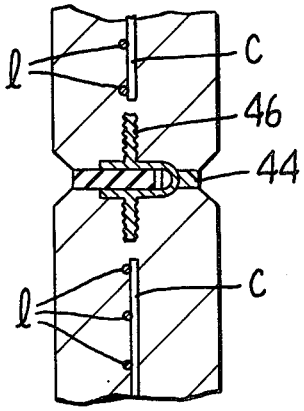
FIG. 7 is a cross-sectional plan view of a waterstop expansion joint which may be formed in the concrete face of a wall constructed according to the present invention.

FIG. 7 illustrates an expansion joint/waterstop which may be incorporated into the concrete face 14. This includes a filler 44 and an elastomeric seal 46. The wire mesh of the trays "T" shown in FIG. 7 is cut at the joint so as to not restrict expansion.

CONCLUSION

While preferred embodiments of the invention have been illustrated and described, it should be understood that the invention is not intended to be limited to the specifics of these embodiments, but rather is defined by the accompanying claims.

What is claimed is:

1. A retaining wall structure comprising: a generally rectangular steel wire tray defined by an elongate floor section extending over the length of the tray and a face section of a depth less than the length of the floor section extending at an angle relative to the floor section, said tray having longitudinal rods extending continuously over the length thereof and across said floor and face sections in spaced, generally parallel relationship to one another and cross rods welded to and extending transversely across said longitudinal rods in spaced relationship to one another; a screen disposed in spaced, generally parallel relationship to the face section to the side thereof from which the floor section extends, said screen being generally coextensive with the face section; and a concrete face coextensive with and cast around said face section, said face being disposed between the mat and face section and being of a thickness sufficient to extend beyond the side of the face section opposite that from which the floor section extends whereby the face section functions to reinforce the face.

2. A retaining wall according to claim 1 wherein said face is of a thickness sufficient to contact said screen.

3. A retaining wall structure comprising: a plurality of generally rectangular steel wire trays, each of said trays being defined by an elongate floor section extending over the length of the tray and a face section of a depth less than the length of the floor section extending at an angle relative to the floor section, said respective trays being disposed in superimposed relationship to one another with the floor sections thereof generally parallel to one other and the face sections of successive trays secured together so that the intersection between the floor and face sections of one tray is secured to the distal edge of the face section of the next adjacent tray, said trays each having longitudinal rods extending continuously over the length thereof and across the floor and face sections in spaced, generally parallel relationship to one another and cross rods welded to and extending transversely across said longitudinal rods in spaced relationship to one another; a screen disposed in spaced, generally parallel relationship to each of said face sections to the side thereof from which the floor section extends; and a concrete face coextensive with and cast around each of said face sections.

4. A retaining wall structure according to claim 3 wherein the face sections of the respective trays are secured together by extended portions formed on the distal ends of the longitudinal rods in the face sections of the trays.

5. A method of constructing a retaining wall, said method comprising:

providing a plurality of generally rectangular steel wire trays, each of said trays being defined by an elongate floor section extending over the length of the tray and a face section of a depth less than the length of the floor section extending at an angle relative to the floor section, said trays each having longitudinal rods extending continuously over the length thereof and across the floor and face sections in spaced, generally parallel relationship to one another and cross rods welded to and extending transversely across said longitudinal rods in spaced relationship to one another;

successively superimposing said trays upon one another with the floor sections thereof generally parallel to one another and the face sections of successive trays secured together so that the intersection between the floor and face sections of one tray is secured to the distal edge of the face section of the next adjacent tray;

placing a screen in spaced relationship to the face section of each tray to the side thereof from which the floor section extends prior to the placement of the next successive tray, said screen being generally coextensive with the face section;

at least partially filling each tray with soil prior to the placement of the next successive tray; and forming a concrete face in place around said face sections whereby said sections function to reinforce said face.

6. A method according to claim 5 wherein the face is formed by spraying the concrete in place.

7. A method according to claim 5 wherein the face is formed by securing form panels to the trays in outwardly spaced relationship to the face sections and pouring concrete between these panels and the screens.

8. A method of constructing a retaining wall, said method comprising:

providing a plurality of generally rectangular steel wire trays, each of said trays being defined by an elongate floor section extending over the length of the tray and a face section of a depth less than the length of the floor section extending at an angle relative to the floor section, said trays each having longitudinal rods extending continuously over the length thereof and across the floor and face sections in spaced, generally parallel relationship to one another and cross rods welded to and extending transversely across said longitudinal rods in spaced relationship to one another;

successively superimposing said trays upon one another with the floor sections thereof generally parallel to one another and the distal edges of the face sections of each tray secured to the next adjacent tray;

at least partially filling each tray with soil prior to the placement of the next successive tray; and forming a concrete face in place around said face sections whereby said sections function to reinforce said face.

* * * * *